US011189447B2

(12) United States Patent
Hua

(10) Patent No.: US 11,189,447 B2
(45) Date of Patent: Nov. 30, 2021

(54) TIME SWITCH OF CONTROLLABLE TIME ADJUSTMENT

(71) Applicant: Yaowu Hua, Shenzhen (CN)

(72) Inventor: Yaowu Hua, Shenzhen (CN)

( * ) Notice: Subject to any disclaimer, the term of this patent is extended or adjusted under 35 U.S.C. 154(b) by 241 days.

(21) Appl. No.: 16/686,178

(22) Filed: Nov. 17, 2019

(65) Prior Publication Data

US 2020/0083007 A1 Mar. 12, 2020

Related U.S. Application Data

(63) Continuation-in-part of application No. 15/277,467, filed on Sep. 27, 2016, now Pat. No. 10,515,773, and (Continued)

(30) Foreign Application Priority Data

Mar. 28, 2014 (CN) ..... 201420148263.2

(51) Int. Cl.
*H01H 50/54* (2006.01)
*H01H 43/02* (2006.01)
(Continued)

(52) U.S. Cl.
CPC ..... *H01H 43/022* (2013.01); *H01H 19/54* (2013.01); *H01H 23/205* (2013.01);
(Continued)

(58) Field of Classification Search
CPC .. H01H 43/022; H01H 43/024; H01H 23/205; H01H 19/54; H01H 2235/01;
(Continued)

(56) References Cited

U.S. PATENT DOCUMENTS 3,165,604 A * 1/1965 Sorenson ..... H01H 23/28 200/437
3,250,887 A * 5/1966 Sorenson ..... H01H 9/18 200/308

(Continued)

FOREIGN PATENT DOCUMENTS

CN 1034286 A 7/1989
CN 2153081 Y 1/1994

(Continued)

*Primary Examiner* — Shawki S Ismail
*Assistant Examiner* — Lisa N Homza

(57) ABSTRACT

A time switch of controllable time adjustment, including a switch housing, a control circuit board, an input terminal, an output terminal, a connecting piece, a first spring, a warped plate, and an electromagnet. The control circuit board is arranged inside the switch housing and electrically connected to the electromagnet and the output terminal. The control circuit board is configured to control the electromagnet to be powered on according to a turn-off time preset by the control circuit board. The first spring is provided between the warped plate and the connecting piece to enable the warped plate to sway around the rotating shaft and drive the connecting piece to sway. The connecting piece is configured to connect the input terminal and the output terminal. The swaying of the connecting piece causes the input terminal and the output terminal to complete closing and opening.

5 Claims, 7 Drawing Sheets

Related U.S. Application Data a continuation of application No. PCT/CN2014/074594, filed on Apr. 2, 2014.

(51) Int. Cl.
*H01H 23/20* (2006.01)
*H01H 19/54* (2006.01)

(52) U.S. Cl.
CPC ..... *H01H 43/024* (2013.01); *H01H 2235/01* (2013.01); *H01H 2239/034* (2013.01)

(58) Field of Classification Search
CPC .. H01H 2239/034; H01H 43/00; H01H 23/06; H01H 3/28
USPC ..... 335/2
See application file for complete search history.

(56) References Cited

U.S. PATENT DOCUMENTS 3,519,775 A * 7/1970 Weremey ..... H01H 23/12 200/556
3,673,358 A * 6/1972 Harmon ..... H01H 5/02 200/6 R
4,000,383 A * 12/1976 Lockard ..... H01H 23/164 200/16 D
4,013,858 A * 3/1977 Grebner ..... H01H 23/12 200/43.04
4,045,650 A * 8/1977 Nestor ..... H01H 1/403 200/556
4,148,002 A * 4/1979 Krasser ..... H01H 71/52 200/339
4,168,416 A * 9/1979 Josemans ..... H01H 27/06 200/302.3
4,169,972 A * 10/1979 Black, III ..... H01H 23/164 200/315
4,187,420 A * 2/1980 Piber ..... H01H 9/20 200/43.16
RE30,273 E * 5/1980 Grebner ..... H01H 23/12 200/321
4,221,941 A * 9/1980 Genovese ..... H01H 23/145 200/339
4,230,917 A * 10/1980 Osika ..... H01H 27/00 200/339
4,242,551 A * 12/1980 Sorenson ..... H01H 23/025 200/302.3
4,291,207 A * 9/1981 Reinke ..... H01H 27/00 200/325
4,307,270 A 12/1981 Smock
4,340,791 A * 7/1982 Sorenson ..... H01H 23/06 200/302.3
4,345,121 A * 8/1982 Tenner ..... H01H 27/00 200/315
4,347,417 A * 8/1982 Sorenson ..... H01H 23/025 200/315
4,352,964 A * 10/1982 English ..... H01H 23/006 200/16 D
4,367,386 A * 1/1983 Sorenson ..... H01H 23/145 200/333
4,383,155 A * 5/1983 Tenner ..... H01H 23/025 200/292
4,386,254 A * 5/1983 Eberhardt ..... H01H 23/06 200/302.1
4,440,994 A * 4/1984 Nat ..... H01H 27/00 200/323
4,680,435 A * 7/1987 Sorenson ..... H01H 23/12 200/275
4,686,339 A * 8/1987 Sapone ..... H01H 23/145 200/330
4,697,053 A * 9/1987 Lockard ..... H01H 23/20 200/303
4,710,602 A * 12/1987 Baity ..... H01H 13/705 200/315
4,767,895 A * 8/1988 Parrish ..... H01H 27/00 200/339
4,777,333 A * 10/1988 Valenzona ..... H01H 23/164 200/339
4,814,554 A * 3/1989 Magiera ..... H01H 23/20 200/339
4,870,230 A * 9/1989 Osika ..... H01H 3/20 200/6 R
4,910,365 A * 3/1990 Kuo ..... H01H 3/20 200/321
4,947,009 A * 8/1990 Osika ..... H01H 3/20 200/43.16
4,967,043 A * 10/1990 Killarney ..... H01H 5/26 200/1 B
5,023,417 A * 6/1991 Magiera ..... H01H 3/36 200/331
5,041,706 A * 8/1991 Osika ..... H01H 23/16 200/296
5,045,648 A * 9/1991 Fogleman, Sr. ..... H01H 27/00 200/43.16
5,047,598 A * 9/1991 Osika ..... H01H 3/20 200/43.16
5,051,550 A * 9/1991 Harris ..... H01H 21/26 200/330
5,053,591 A * 10/1991 Theurer ..... H01H 23/065 200/315
5,095,181 A * 3/1992 Osika ..... H01H 3/20 200/339
5,107,082 A * 4/1992 Valenzona ..... H01H 23/025 200/292
5,136,130 A * 8/1992 Daly ..... H01H 9/06 200/318.1
5,213,204 A * 5/1993 Sommer ..... H01H 23/04 200/303
5,239,143 A * 8/1993 Valenzona ..... H01H 27/00 200/339
5,270,505 A * 12/1993 Magiera ..... H01H 3/36 200/331
5,293,018 A * 3/1994 Lander ..... H01H 23/26 200/339
5,336,859 A * 8/1994 Wojtanek ..... H01H 23/025 200/315
5,336,861 A * 8/1994 Cummins ..... H01H 23/145 200/339
5,412,165 A * 5/1995 Malone ..... H01H 3/50 200/17 R
5,412,169 A * 5/1995 Comerci ..... H01H 23/143 200/339
5,451,729 A * 9/1995 Onderka ..... H01H 73/26 200/18
5,491,460 A * 2/1996 Krasser ..... H01H 77/04 337/70
5,508,479 A * 4/1996 Schooley ..... H01H 9/0214 200/18
5,559,311 A * 9/1996 Gorbatoff ..... H01H 13/70 200/1 B
5,560,475 A * 10/1996 Brundage ..... H01H 23/025 200/313
5,738,206 A * 4/1998 Souza ..... H01H 3/20 200/322
5,833,048 A * 11/1998 Dilly ..... H01H 23/16 200/446
5,950,812 A * 9/1999 Tanacan ..... H01H 23/205 200/458
6,013,885 A * 1/2000 Kowalczyk ..... H01H 23/025 200/302.3
6,130,393 A * 10/2000 Chu ..... H01H 23/164 200/339
6,339,201 B1 * 1/2002 Balaban ..... H01H 23/00 200/339
6,549,113 B1 * 4/2003 Woodard ..... H01H 23/065 277/650
6,797,905 B1 * 9/2004 Wang ..... H01H 23/205 200/339
6,861,606 B2 * 3/2005 Ribeiro ..... H01H 71/54 200/339

(56) References Cited

U.S. PATENT DOCUMENTS 6,919,523 B1 * 7/2005 Lai ..... H01H 23/06 200/339
6,967,298 B2 * 11/2005 Schmidt ..... H01H 1/18 200/330
7,026,565 B1 * 4/2006 Lee ..... H01H 23/205 200/339
7,105,762 B1 * 9/2006 Lee ..... H01H 23/025 200/339
7,745,750 B2 * 6/2010 Hewson ..... H01H 3/0213 200/339
8,541,706 B2 * 9/2013 Limbert ..... H01H 23/06 200/302.3
8,853,893 B2 * 10/2014 Savicki, Jr. ..... H01H 23/025 307/140
2002/0104748 A1 * 8/2002 Levendis ..... H01H 23/12 200/339
2003/0029710 A1 * 2/2003 Spedale ..... H01H 23/30 200/553
2003/0038020 A1 * 2/2003 Taniuchi ..... H01H 23/14 200/339
2005/0006214 A1 * 1/2005 Fujii ..... H01H 3/60 200/339
2005/0109598 A1 * 5/2005 Endres ..... H01H 21/245 200/339
2005/0115818 A1 * 6/2005 Kurek ..... H02G 3/14 200/553
2006/0108211 A1 * 5/2006 Endres ..... H01H 21/025 200/558
2006/0131152 A1 * 6/2006 Endres ..... H01H 21/245 200/339
2007/0095642 A1 * 5/2007 Endres ..... H01H 21/025 200/339
2007/0170047 A1 * 7/2007 Ullermann ..... H01H 23/164 200/339
2009/0160354 A1 * 6/2009 Burrell ..... H05B 47/185 315/291
2010/0126838 A1 * 5/2010 Lee ..... H01H 23/168 200/339
2011/0280608 A1 * 11/2011 Amemiya ..... G03G 15/5016 399/88
2012/0067708 A1 * 3/2012 Lee ..... H01H 71/18 200/293
2012/0118713 A1 * 5/2012 Sadowski ..... H01H 3/42 200/11 J
2012/0118717 A1 * 5/2012 Hanson ..... H01H 23/143 200/5 A

FOREIGN PATENT DOCUMENTS

CN 201138643 Y 10/2008
CN 202996712 U 6/2013
JP 2012074301 A 4/2012
JP 5107385 B2 12/2012

* cited by examiner

TIME SWITCH OF CONTROLLABLE TIME ADJUSTMENT

CROSS-REFERENCE TO RELATED APPLICATIONS

This application is a Continuation-in-part of patent application Ser. No. 15/277,467, filed on Sep. 27, 2016, which is a continuation of International Patent Application No. PCT/CN2014/074594 with a filing date of Apr. 2, 2014, and further claims priority to Chinese Patent Application No. 201420148263.2 with a filing date of Mar. 28, 2014. The content of the aforementioned applications, including any intervening amendments thereto, are incorporated herein by reference.

TECHNICAL FIELD

The present invention relates to the field of switch, and more specifically, to a time switch capable of setting time freely to control the switch disconnection.

BACKGROUND OF THE INVENTION

To solve stand-by power consumption on the electrical appliances, many product designers design a time switch circuit on the electrical appliances. When the time switch is connected in the circuit, the electrical appliances can judge power on or off according to the setting time, so that the stand-by state can be stopped in time and power consumption can be saved.

In industry practice, time switch is generally supplied to manufacturers of electrical appliances as finished switch, and the manufacturers design corresponding circuit module and installation structure on electrical goods to match with the appearance of time switch. Currently, there are two types of time switch at home and abroad, one is permanent magnet type in a way of suction, its product structure determines defects of unstable performance, poor hand feeling in opening and closing button during using; the other is spring-type rocker switch, which has good hand feeling due to optimization of inner springback structure, and this time switch is frequently used in China. Traditional time switch described hereinafter is spring-type rocker switch.

The structure of traditional time switch comprises a cuboid-shaped switch body, a circuit board and touch points are arranged inside the switch body, a ship-shaped button is arranged in front of the switch body, rotating shaft holes are arranged on both sides of the ship-shaped button, the touch points are aligned to two ends of the ship-shaped knob. It is necessary that the rotating shaft is inserted into the rotating shaft holes because pulling action of both ends of the ship-shaped button needs to be realized. However, for traditional time switch, structure designs such as rotating shaft are solved by manufacturers of electrical appliances, that is, a switch mounting bracket for embedding switch body is designed on panel of electrical appliances, and a rotating shaft is arranged on the mounting bracket. In this way, the manufacturing and assembling of the complete set of time switch meet trouble, many structures of electrical appliances' panel are interfered with each other and are not easy to open the mold; accessories are scattered, the assembly of time switch is unstable; because products are designed independently by both sides, it cannot be well matched in actual assembling; ship-shaped button is single and replacement is difficult.

SUMMARY OF THE INVENTION

The present invention aims to solve problems of single button and difficult replacement by providing a time switch of controllable time adjustment.

The present invention is realized as follows: a time switch of controllable time adjustment, the time switch comprises a switch housing, a control circuit board, an input terminal, an output terminal, a connecting piece, a first spring, a warped plate, and an electromagnet; the control circuit board is arranged inside the switch housing and electrically connected to the electromagnet and the output terminal; the control circuit board is configured to control the electromagnet to be powered on according to a turn-off time preset by the control circuit board; the electromagnet is configured to push the warped plate; the warped plate configured to bend the first spring is connected to the switch housing by means of a rotating shaft; the first spring is provided between the warped plate and the connecting piece to enable the warped plate to sway around the rotating shaft and drive the connecting piece to sway; the connecting piece is configured to connect the input terminal and the output terminal; the input terminal and the output terminal are arranged on a bottom surface of the switch housing; the swaying of the connecting piece causes the input terminal and the output terminal to complete closing and opening, such that the time switch is turned on and off.

A further technical scheme of the present invention is the time switch also comprises a microcontroller configured to control the electromagnet to be powered on according to the turn-off time.

A further technical scheme of the present invention is the time switch also comprises a timing rotary switch, the timing rotary switch is electrically connected with the control circuit board.

A further technical scheme of the present invention is the timing rotary switch comprises a first circuit board, a rotary switch, a rotary knob and a case; a circular hole is arranged on the top surface of the case, the rotary knob is exposed out of the case through the circular hole for rotation, the rotary switch is arranged on the first circuit board; the rotary knob is sleeved on a rotary shaft of the rotary switch; and the first circuit board is connected with the control circuit board by the plug wire.

A further technical scheme of the present invention is the time switch also comprises a waterproof rubber ring, the waterproof rubber ring is arranged inside the switch housing; and the waterproof rubber ring is provided between the warped plate, the connecting piece and the control circuit board.

A further technical scheme of the present invention is the time switch also comprises a bottom cover, the bottom cover is connected to the body of the time switch via a buckle.

A further technical scheme of the present invention is an opening is provided on the top surface of the warped plate; a lamp cover is connected with the inner of the opening via a buckle.

A further technical scheme of the present invention is the electromagnet comprises a copper coil, a coil framework, a second spring, a terminal and an iron core, the second spring is sleeved on the iron core, the iron core is arranged inside the coil framework, the copper coil is wound and sleeved on the coil framework; the terminal is provided on the coil framework; and the copper coil is electrically connected to the terminal.

A further technical scheme of the present invention is the control circuit comprises a coil J1, a resistor R4, a resistor R3, a resistor R2, a resistor R1, a capacitor C1, a capacitor C4, a diode D1, a diode D2, a neon tube N-LD, a silicon controlled rectifier Q1, a control chip U1 and a connector JP1, an input voltage is connected to the input terminal of the coil, the output terminal of the coil is respectively connected to one end of the resistor R4 and the second pin of the silicon controlled rectifier Q1, the other end of the resistor R4 is grounded, the first pin of the silicon controlled rectifier Q1 is grounded, the third pin of the silicon controlled rectifier Q1 is connected to one end of the resistor R3, the other end of the resistor R3 is connected to the fifth pin of the control chip U1, one end of the capacitor C4 is grounded, and the other end is respectively connected to the third pin of a triode Q5 and the third pin of a triode Q1, the eighth pin of the control chip U1 is respectively connected to the third pin and the sixth pin of the connector JP1, the seventh pin of the control chip U1 is connected to the third pin of the connector JP1, the sixth pin of the control chip U1 is grounded, the third pin and the fourth pin of the control chip U1 are respectively connected to the first pin of the connector JP1, the second pin of the control chip U1 is connected to the second pin of the connector JP1, the first pin of the connector JP1 is respectively connected to the cathode of the diode D2 and the anode of the capacitor C1, the anode of the diode D2 and the cathode of the capacitor C1 are grounded, the anode of the diode D1 is connected to one end of the resistor R1, and the other end of the resistor R1 is connected to the input voltage, one end of the resistor R2 is grounded, and the other end of the resistor R2 is connected to the anode of the neon tube N-LD, the cathode of the neon tube N-LD is connected to the input voltage.

A further technical scheme of the present invention is a time adjusting circuit is arranged on the first circuit board, the time adjusting circuit comprises a control chip U2, a capacitor C5, a diode D3, a rotary switch SW1 and a connector JP2, the first pin of the control chip U2 is connected to the third pin of the connector JP2, the second pin of the the control chip U2 is grounded, the third pin of the control chip U2 is connected to the third pin of the rotary switch SW1, the fourth pin of the control chip U2 is connected to the first pin of the rotary switch SW1, the fifth pin of the control chip U2 is connected to the input voltage, the sixth pin of the control chip U2 is connected to the sixth pin of the rotary switch SW1, the seventh pin of the control chip U2 is connected to the fourth pin of the rotary switch SW1, the eighth pin of the control chip U2 is unconnected, the ninth pin of the control chip U2 is connected to the first pin of the connector JP2, the tenth pin of the control chip U2 is connected to the second pin of the connector JP2, one end of the diode D3 is connected to the first pin of the connector JP2, and the other end of the diode D3 is respectively connected to the anode and input voltage of the capacitor C5, the cathode of the capacitor C5 is grounded, the second pin and the fifth pin of the rotary switch SW1 are grounded.

The beneficial effects of the present invention is as follows: the present invention has a rotating shaft in the time switch, so that manufacturers of electric appliances using the switch have no need to design the rotating shaft on the switch mounting bracket of electrical appliances, and reduce trouble of mold design; in addition, a middle clamping rack is disposed, through which the switch body can be easily installed on the panel, and it is very easy to be assembled and disassembled due to clamping structure. The present invention has a simple and reliable structure and a convenient installation, so it can be installed in various electric appliances needing to realize a timing function.

Reference numbers: 1—lamp cover; 2—warped plate; 3—waterproof rubber ring; 4—first spring; 5—connecting piece; 6—input terminal; 7—output terminal; 8—terminal; 9—control circuit board; 10—switch housing; 11—copper coil; 12—coil framework; 13—second spring; 14—iron core; 15—bottom cover; 16—rotating shaft; 17—buckle; 18—buckle hole; 19—leg; 20—center hole; 21—column; 22—microcontroller; 23—neon tube; 30—electromagnet; 40—timing rotary switch; 401—first circuit board; 402—rotary switch; 403—rotary knob; 404—case; 405—plug wire; 406—pluggable plug; 407—circular hole; 408—rotary shaft.

DETAILED DESCRIPTION OF EMBODIMENTS

Figure 1:
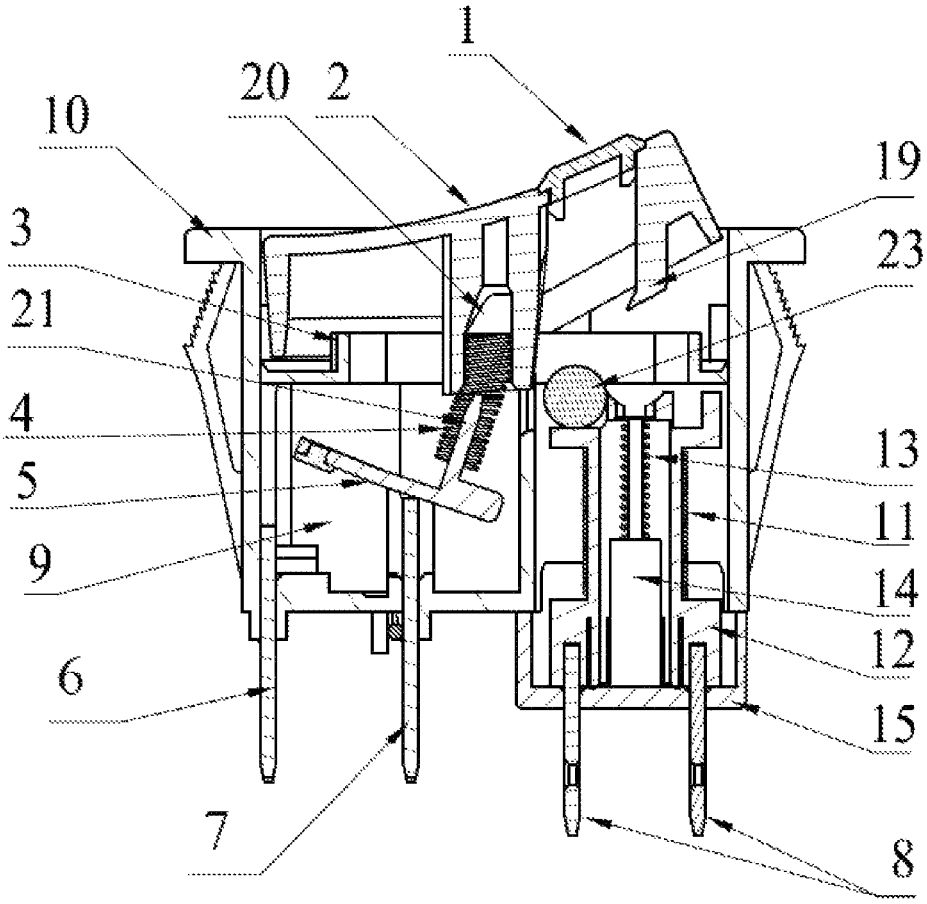
FIG. 1 is a section view of a time switch of controllable time adjustment of the present invention.
Figure 2:
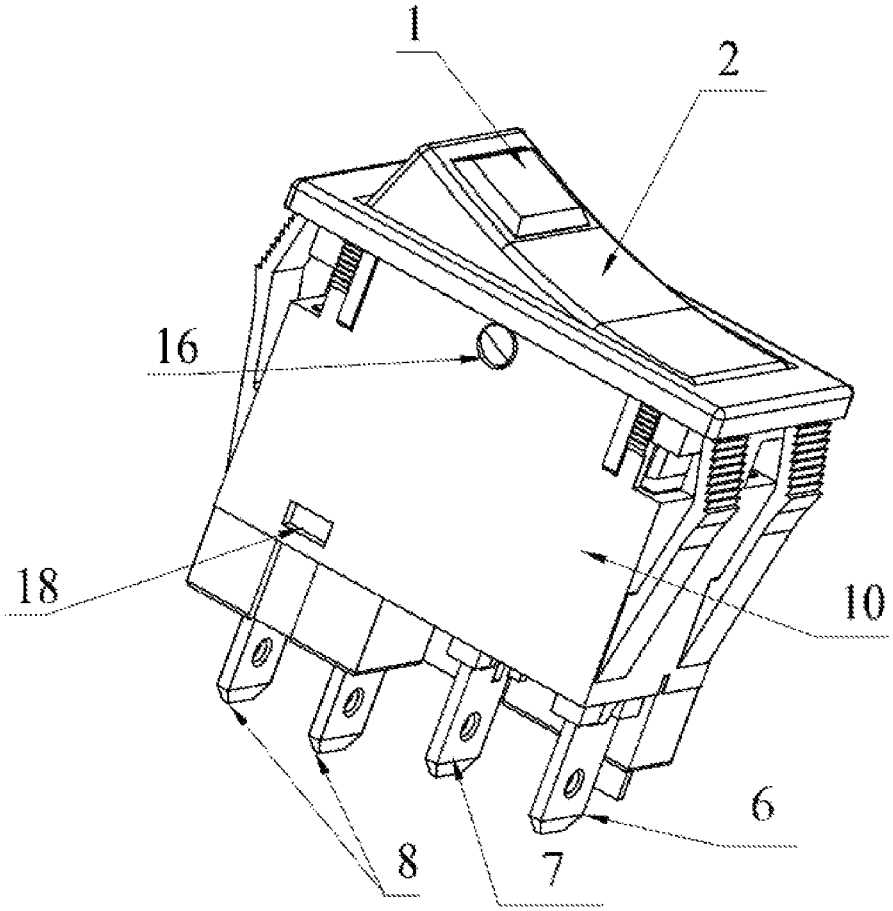
FIG. 2 is a three-dimensional diagram of the time switch of controllable time adjustment of the present invention.
Figure 3:
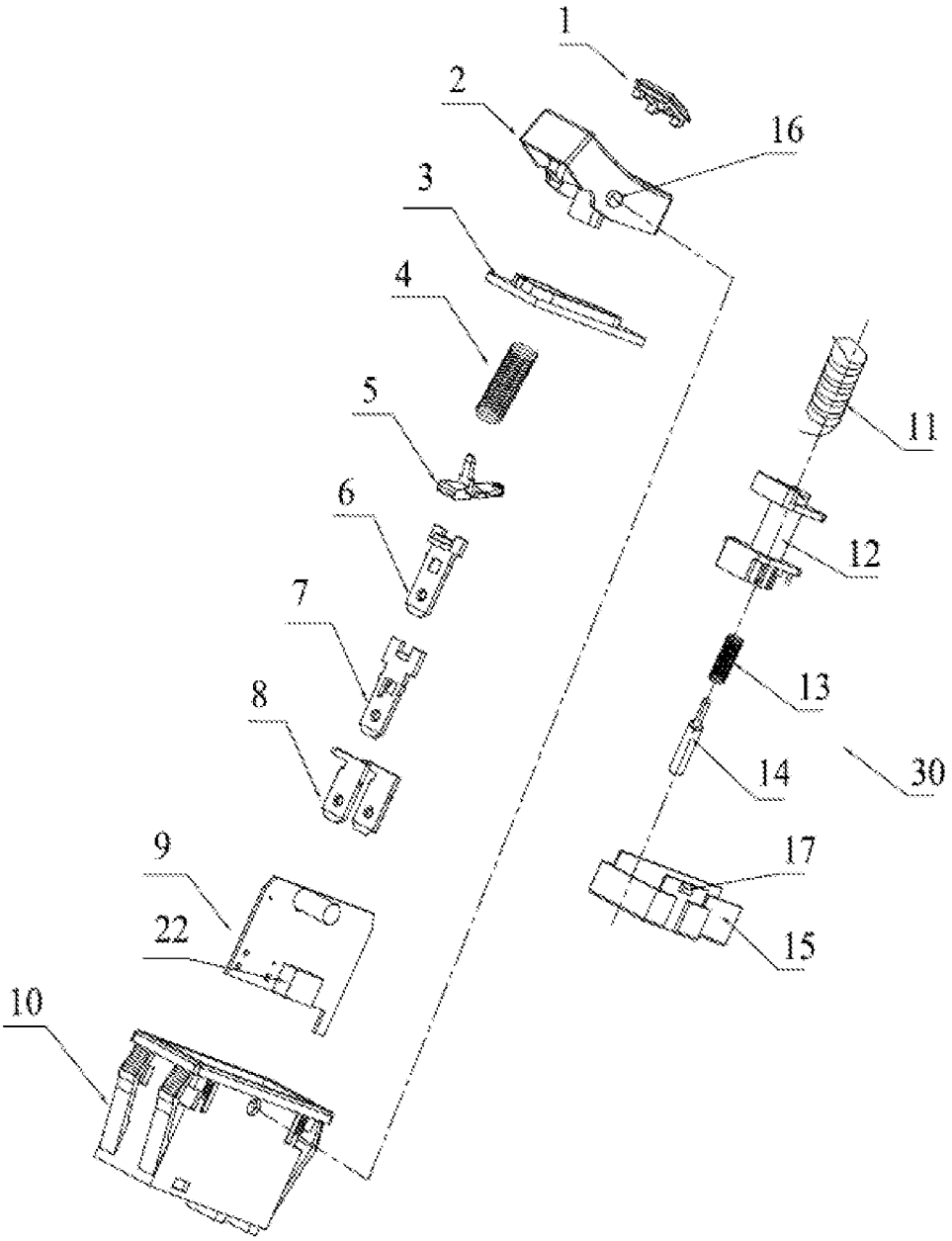
FIG. 3 is a break-down structure diagram of the time switch of controllable time adjustment of the present invention.

FIGS. 1-3 show a time switch of controllable time adjustment of the present invention, the time switch comprises a switch housing 10, a control circuit board 9 arranged inside the switch housing 10, an input terminal 6 and an output terminal 7 arranged on the bottom surface of the switch housing 10, a connecting piece 5 for connecting the input terminal 6 and the output terminal 7, a warped plate 2 connecting to the switch housing 10 by means of a rotating shaft 16. The warped plate 2 includes a leg 19, a rotating shaft 16 and a center hole 20. The warped plate 2 is connected to the switch housing 10 by means of the rotating shaft 16. A first spring 4 is provided between the warped plate 2 and the connecting piece 5 enabling the warped plate 2 to sway around the rotating shaft 16 and drive the connecting piece 5 to sway. Specifically, one end of the first spring 4 is inserted into the center hole 20 and the other end of the first spring 4 is sleeved on a column 21 provided on the connecting piece 5. An end of the connecting piece 5 is connected to the output terminal 7. The swaying of the connecting piece 5 causes the input terminal 6 and the output terminal 7 to complete closing and opening. The control circuit board 9 is electrically connected with the output terminal 7. When the warped plate 2 is pressed, the leg 19 abuts on an upper end of the coil framework 12 and the first spring 4 is released by the center hole 20. Then the connecting piece 5 sways, such that an end of the connecting piece 5 is connected to the input terminal 6. Thus, the input terminal 6 and the output terminal 7 are connected, such that the time switch is turned on. At the same time, the control circuit board 9 is powered on. The control circuit board 9 is provided with a microcontroller 22 configured to control the electromagnet 30 to be powered on according to a turn-off time preset in the microcontroller 22. When the preset turn-off time is up, the microcontroller 22 controls the electromagnet 30 to be powered on. For example, the turn-off time value is preset as one minute, when the one minute is up, the microcontroller 22 controls the electromagnet 30 to be powered on. Then the electromagnet 30 generates an electromagnetic force which pushes the leg 19, such that an end of the warped plate 2 rises. Then the first spring 4 is bended by the center hole 20. The connecting piece 5 is pressed by the first spring 4, such that an end of the connecting piece 5 is disconnected to the input terminal 6. Finally, the input terminal 6 and the output terminal 7 are disconnected, such that the time switch is turned off. At the same time, the control circuit board 9 and the electromagnet 30 are powered off. Specifically, the microcontroller 22 includes a timer configured to control the electromagnet 30 to be powered on according to the turn-off time. The present invention has a rotating shaft 16 in the time switch, so that manufacturers of electric appliances using the switch have no need to design the rotating shaft 16 on the switch mounting bracket of electrical appliances, and reduce trouble of mold design; in addition, a middle clamping rack is disposed, through which the switch body can easily installed on the panel, and it is very easy to be assembled and disassembled due to clamping structure. The present invention has a simple and reliable structure and a convenient installation, so it can be installed in various electric appliances needing to realize a timing function.

After a bottom cover 15 and the circuit board are combined and connected with the switch housing 10, the whole product design has delicate structure, so that the product has smaller volume, lower cost, and easy installation, besides, it is convenient for users to install and use.

Figure 4:
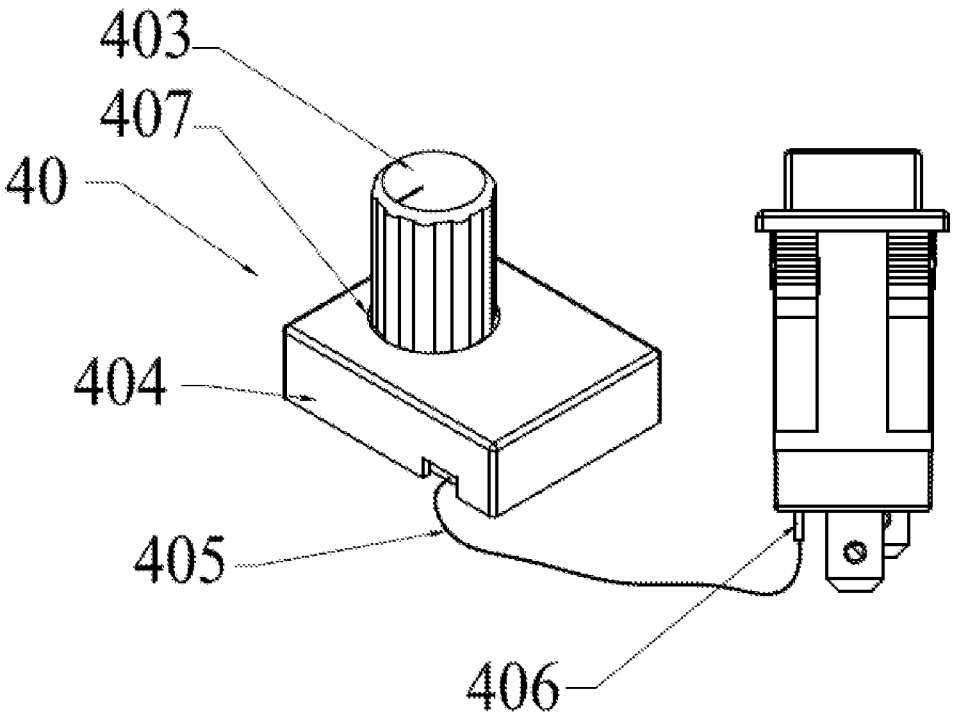
FIG. 4 is a three-dimensional diagram of a timing rotary switch of the present invention.

The time switch also comprises a timing rotary switch 40. As shown in FIG. 4, the timing rotary switch 40 is electrically connected to the control circuit board 9 in a plugging manner by a plug wire 405. Specifically, the plug wire 405 is connected to a pluggable plug 406 of the control circuit board 9. In some embodiments, the timing rotary switch 40 is integrated in the control circuit board 9. The timing rotary switch 40 is configured to set various turn-off time values. Then the microcontroller 22 of the control circuit board 9 will control the time switch to turn off according to the various turn-off time values. For example, the turn-off time values may be set as 1 minute, 2 minutes or 10 minutes and so on. When the turn-off time value is set as 1 minute, the turn-off time value of 1 minute is received by the control circuit board 9 and then allocated to the microcontroller 22. The microcontroller 22 controls the electromagnet 30 to be powered on when the 1 minute is up. Then the time switch is turned off. That means the turn-off time values in the control circuit board 9 are able to be adjusted by the timing rotary switch 40. The time of switch disconnection can be set freely, so that actual demand meet users' need.

Figure 5:
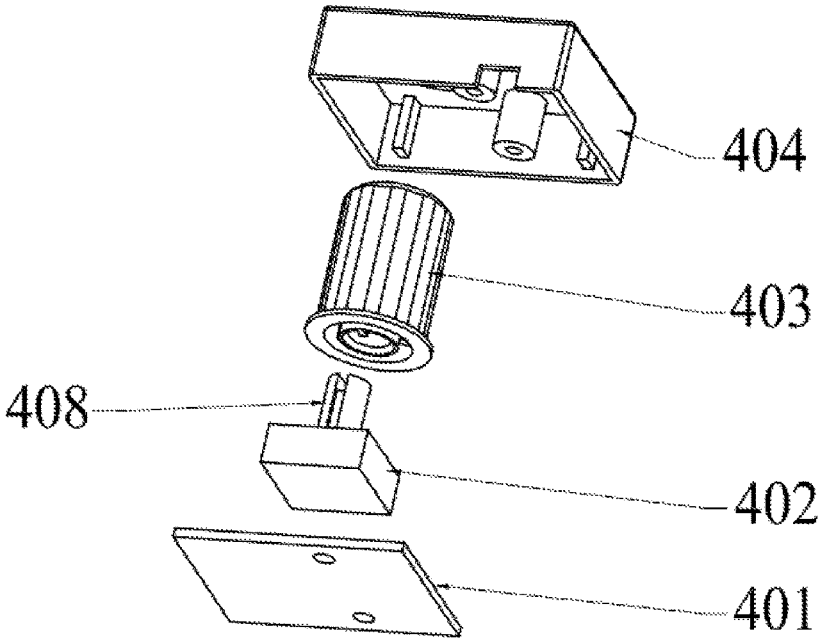
FIG. 5 is a break-down structure diagram of the timing rotary switch of the present invention.
Figure 6:
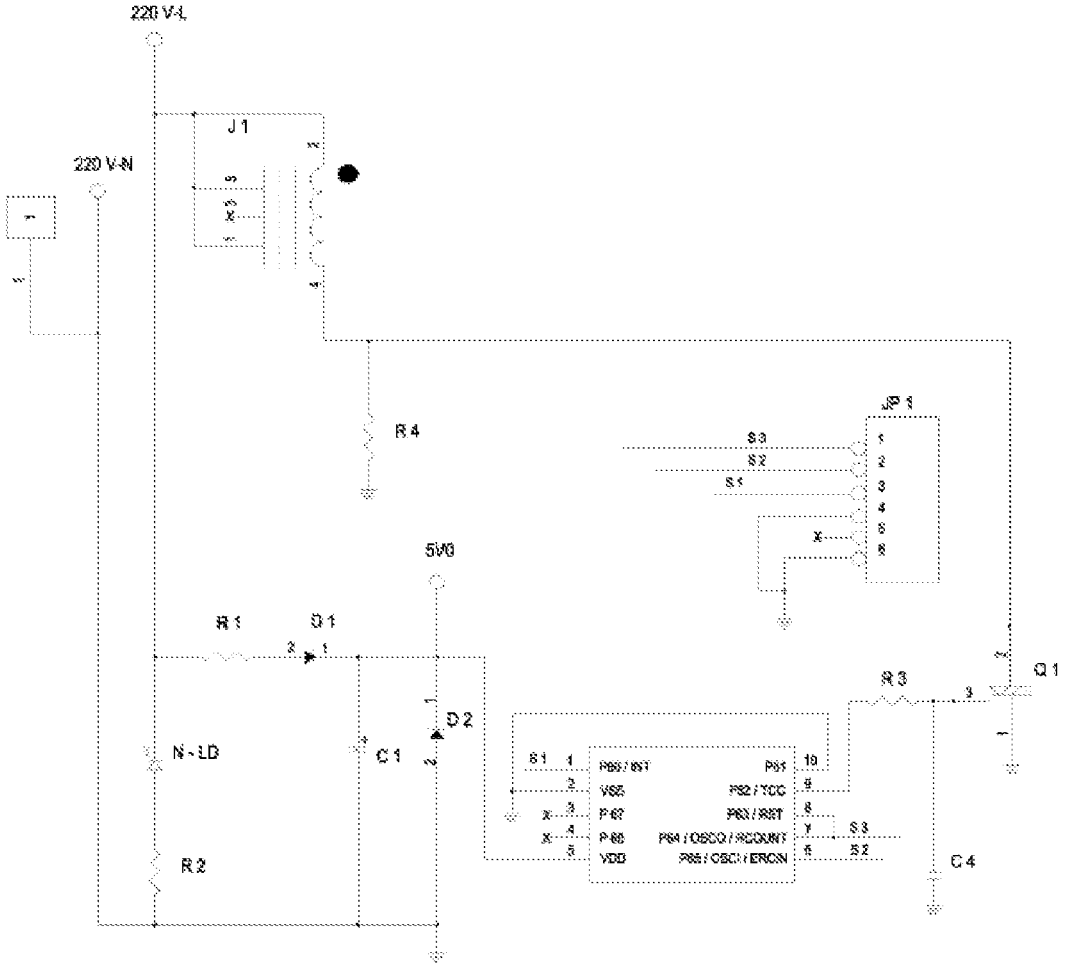
FIG. 6 is a circuit diagram of a control circuit of a time switch of controllable time adjustment of the present invention.
Figure 7:
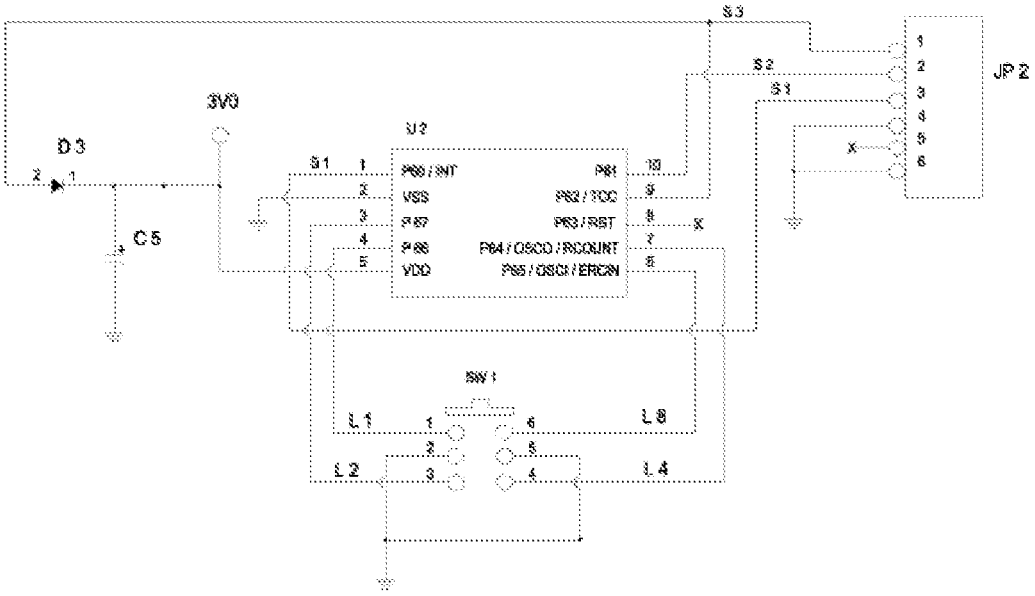
FIG. 7 is a circuit diagram of a timing circuit of a time switch of controllable time adjustment of the present invention.

As shown in FIGS. 4-5, the timing rotary switch 40 comprises a first circuit board 401, a rotary switch 402, a rotary knob 403, a case 404 and the plug wire 405; a circular hole 407 is arranged on the top surface of the case 404, the rotary knob 403 is exposed out of the case 404 through the circular hole 407 for rotation, the rotary switch 402 is arranged on the first circuit board 401, the rotary knob 403 is sleeved on a rotary shaft 408 of the rotary switch 402; and the first circuit board 401 is connected with the control circuit board 9 by the plug wire 405. The rotary knob 403 is rotated to set the turn-off time values.

The time switch also comprises a waterproof rubber ring 3, the waterproof rubber ring 3 is arranged inside the switch housing 10, the waterproof rubber ring 3 is provided between the warped plate 2, the connecting piece 5 and the control circuit board, so that small amount of water inside can be discharged to prevent short circuit inside the switch.

As shown in FIGS. 2-3, the time switch also comprises the bottom cover 15 provided with a buckle 17. The switch housing 10 is provided with a buckle hole 18. The bottom cover 15 is connected to the switch housing 10 via a buckle 17. Specifically, the buckle 17 is connected to buckle hole 18. Buckle connection is convenient for disassembling and maintenance.

As shown in FIG. 1, an opening is provided on the top surface of the warped plate 2, a lamp cover 1 is clamped in inner of the opening. A neon tube 23 emits a light passing through the lamp cover 1, so that an indication of neon tube shining can be obtained.

The electromagnet 30 is arranged on the control circuit board 9, and a control circuit is arranged inside the control circuit board 9.

The electromagnet 30 comprises a copper coil 11, a coil framework 12, a second spring 13, a terminal 8 and an iron core 14, the second spring 13 is sleeved on the iron core 14, the iron core 14 is arranged inside the coil framework 12, the copper coil 11 is wound on the coil framework 12, the terminal 8 is provided on the coil framework 12 and the copper coil 11 is electrically connected to the terminal 8.

The control circuit comprises a coil J1, a resistor R4, a resistor R3, a resistor R2, a resistor R1, a capacitor C1, a capacitor C4, a diode D1, a diode D2, a neon tube N-LD, a silicon controlled rectifier Q1, a control chip U1 and a connector JP1, an input voltage is connected to the input terminal of the coil, the output terminal of the coil is respectively connected to one end of the resistor R4 and the second pin of the silicon controlled rectifier Q1, the other end of the resistor R4 is grounded, the first pin of the silicon controlled rectifier Q1 is grounded, the third pin of the silicon controlled rectifier Q1 is connected to one end of the resistor R3, the other end of the resistor R3 is connected to the fifth pin of the control chip U1, one end of the capacitor C4 is grounded, and the other end is respectively connected to the third pin of a triode Q5 and the third pin of a triode Q1, the eighth pin of the control chip U1 is respectively connected to the third pin and the sixth pin of the connector JP1, the seventh pin of the control chip U1 is connected to the third pin of the connector JP1, the sixth pin of the control chip U1 is grounded, the third pin and the fourth pin of the control chip U1 are respectively connected to the first pin of the connector JP1, the second pin of the control chip U1 is connected to the second pin of the connector JP1, the first pin of the connector JP1 is respectively connected to the cathode of the diode D2 and the anode of the capacitor C1, the anode of the diode D2 and the cathode of the capacitor C1 are grounded, the anode of the diode D1 is connected to one end of the resistor R1, and the other end of the resistor R1 is connected to the input voltage, one end of the resistor R2 is grounded, and the other end of the resistor R2 is connected to the anode of the neon tube N-LD, the cathode of the neon tube N-LD is connected to the input voltage.

A time adjusting circuit is arranged on the first circuit board, the time adjusting circuit comprises a control chip U2, a capacitor C5, a diode D3, a rotary switch SW1 and a connector JP2, the first pin of the control chip U2 is connected to the third pin of the connector JP2, the second pin of the control chip U2 is grounded, the third pin of the control chip U2 is connected to the third pin of the rotary switch SW1, the fourth pin of the control chip U2 is connected to the first pin of the rotary switch SW1, the fifth pin of the control chip U2 is connected to the input voltage, the sixth pin of the control chip U2 is connected to the sixth pin of the rotary switch SW1, the seventh pin of the control chip U2 is connected to the fourth pin of the rotary switch SW1, the eighth pin of the control chip U2 is unconnected, the ninth pin of the control chip U2 is connected to the first pin of the connector JP2, the tenth pin of the control chip U2 is connected to the second pin of the connector JP2, one end of the diode D3 is connected to the first pin of the connector JP2, and the other end of the diode D3 is connected to the anode and input voltage of the capacitor C5, the cathode of the capacitor C5 is grounded, the second pin and the fifth pin of the rotary switch SW1 are grounded.

Above disclosure are merely some preferred embodiments of the present invention, and the present invention is not limited thereto. Any variations, equivalent replacement and modifications under the spirit and principle of the present invention shall be covered within the scope of the present invention.

What is claimed is:

1. A time switch of controllable time adjustment, comprising:

a switch housing, a control circuit board, an input terminal, an output terminal, a connecting piece, a first spring, a warped plate, and an electromagnet; wherein the control circuit board is arranged inside the switch housing and electrically connected to the electromagnet and the output terminal; the control circuit board is configured to control the electromagnet to be powered on according to a turn-off time preset by the control circuit board;

the electromagnet is configured to push the warped plate;

the warped plate configured to bend the first spring is connected to the switch housing by means of a rotating shaft;

the first spring is provided between the warped plate and the connecting piece to enable the warped plate to sway around the rotating shaft and drive the connecting piece to sway;

the connecting piece is configured to connect the input terminal and the output terminal;

the input terminal and the output terminal are arranged on a bottom surface of the switch housing; the swaying of the connecting piece causes the input terminal and the output terminal to complete closing and opening, such that the time switch is turned on and off;

wherein the time switch further comprises a timing rotary switch electrically connected with the control circuit board;

wherein the timing rotary switch comprises a first circuit board, a rotary switch, a rotary knob and a case; a circular hole is arranged on a top surface of the case; the rotary knob is exposed out of the case through the circular hole for rotation; the rotary switch is set on the first circuit board; the rotary knob is sleeved on a rotary shaft of the rotary switch; and the first circuit board is electrically connected with the control circuit board by a plug wire;

wherein the time switch further comprises a waterproof rubber ring arranged inside the switch housing; and the waterproof rubber ring is provided between the warped plate, the connecting piece and the control circuit board.

2. The time switch of claim 1, wherein the control circuit board comprises a microcontroller configured to control the electromagnet to be powered on according to the turn-off time.

3. The time switch of claim 1, wherein the time switch further comprises a bottom cover connected to the switch housing of the time switch via a buckle.

4. The time switch of claim 1, wherein an opening is provided on a top surface of the warped plate; a lamp cover is clamped in inner of the opening.

5. The time switch of claim 1, wherein the electromagnet comprises a copper coil, a coil framework, a second spring, a terminal and an iron core; the second spring is sleeved on the iron core, the iron core is arranged inside the coil framework, the copper coil is wound and sleeved on the coil framework; the terminal is provided on the coil framework; and the copper coil is electrically connected to the terminal.

* * * * *